US009383691B2

(12) United States Patent
Wada et al.

(10) Patent No.: US 9,383,691 B2
(45) Date of Patent: Jul. 5, 2016

(54) IMAGE FORMING APPARATUS INCLUDING A TRANSFER BIAS CONTROLLER

(71) Applicants: Yuuji Wada, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Yusuke Mitani, Kanagawa (JP); Kazuki Yogosawa, Tokyo (JP)

(72) Inventors: Yuuji Wada, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Yusuke Mitani, Kanagawa (JP); Kazuki Yogosawa, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/742,730

(22) Filed: Jun. 18, 2015

(65) Prior Publication Data

US 2015/0378284 A1 Dec. 31, 2015

(30) Foreign Application Priority Data

Jun. 25, 2014 (JP) ..... 2014-130253

(51) Int. Cl.
*G03G 15/16* (2006.01)

(52) U.S. Cl.
CPC ..... *G03G 15/1695* (2013.01); *G03G 15/1675* (2013.01); *G03G 15/161* (2013.01); *G03G 15/168* (2013.01)

(58) Field of Classification Search
CPC ..... G03G 15/1665; G03G 15/1675; G03G 2215/16; G03G 2215/1666; G03G 15/1695
USPC ..... 399/66, 45, 302, 314, 316, 390
See application file for complete search history.

(56) References Cited

U.S. PATENT DOCUMENTS

| | | | | |
|---|---|---|---|---|
| 6,438,333 | B1 * | 8/2002 | Katsumi | G03G 15/1645 399/66 X |
| 7,295,796 | B1 | 11/2007 | Murakami et al. | |
| 2005/0025520 | A1 | 2/2005 | Murakami et al. | |
| 2005/0201782 | A1 * | 9/2005 | Fuchiwaki | G03G 15/6558 399/316 |
| 2007/0025780 | A1 * | 2/2007 | Kurosu | G03G 15/16 399/313 |
| 2010/0046969 | A1 * | 2/2010 | Kim | G03G 15/1605 399/45 X |
| 2010/0142985 | A1 | 6/2010 | Minbe et al. | |
| 2010/0221029 | A1 | 9/2010 | Minbu et al. | |
| 2010/0329707 | A1 * | 12/2010 | Yamada | G03G 15/161 399/45 X |

(Continued)

FOREIGN PATENT DOCUMENTS

| | | |
|---|---|---|
| JP | 3-180881 | 8/1991 |
| JP | 10-240032 | 9/1998 |

(Continued)

*Primary Examiner* — Sophia S Chen
(74) *Attorney, Agent, or Firm* — Harness, Dickey & Pierce, P.L.C.

(57) ABSTRACT

An image forming apparatus includes a transfer device to transfer a toner image onto a recording medium with a transfer bias applied thereto, a recording medium conveyor to deliver the recording medium to a transfer region while controlling an alignment of the recording medium having entered the transfer region in alignment control, and a transfer bias controller to obtain a toner adhesion amount information on a post-alignment-control toner image that passes through the transfer region after the recording medium is free from the alignment control, and to reduce, when the toner adhesion amount per unit area is less than a predetermined amount, the transfer bias after the alignment control is released to a level less than that of a transfer bias that is applied when the toner image having a same toner adhesion amount passes through the transfer region before the recording medium is free from the alignment control.

8 Claims, 9 Drawing Sheets

(56) References Cited

U.S. PATENT DOCUMENTS

| | | | | |
|---|---|---|---|---|
| 2011/0013920 | A1 | 1/2011 | Wada | |
| 2011/0158690 | A1 | 6/2011 | Mimbu et al. | |
| 2011/0222128 | A1 | 9/2011 | Wada | |
| 2011/0255892 | A1 | 10/2011 | Aoki | |
| 2012/0269529 | A1* | 10/2012 | Heid | G03G 15/1675 399/66 |
| 2012/0308250 | A1 | 12/2012 | Shimizu et al. | |
| 2012/0315058 | A1 | 12/2012 | Shimizu et al. | |
| 2012/0328315 | A1 | 12/2012 | Takeuchi et al. | |
| 2012/0328321 | A1 | 12/2012 | Takeuchi et al. | |
| 2013/0004190 | A1 | 1/2013 | Sengoku et al. | |
| 2013/0051828 | A1 | 2/2013 | Yogosawa et al. | |
| 2013/0051872 | A1* | 2/2013 | Matayoshi | G03G 15/0189 399/302 |
| 2013/0223901 | A1 | 8/2013 | Minbe et al. | |
| 2013/0322935 | A1 | 12/2013 | Ichihashi et al. | |
| 2014/0072340 | A1 | 3/2014 | Kato et al. | |
| 2014/0255050 | A1 | 9/2014 | Yoshida et al. | |
| 2014/0270819 | A1 | 9/2014 | Wada et al. | |
| 2014/0334847 | A1 | 11/2014 | Takahashi et al. | |
| 2015/0037054 | A1 | 2/2015 | Nagata et al. | |
| 2015/0185668 | A1* | 7/2015 | Matsuzaki | G03G 15/1675 399/66 |

FOREIGN PATENT DOCUMENTS

| | | |
|---|---|---|
| JP | 2003-167496 | 6/2003 |
| JP | 2007-264430 | 10/2007 |
| JP | 2011-227174 | 11/2011 |

* cited by examiner

FIG. 7

| QUALITY \ SECONDARY TRANSFER CURRENT [−μA] | 20 | 40 | 60 | 80 | 100 | 120 | 140 |
|---|---|---|---|---|---|---|---|
| HT AREA-B TONER VOID | GOOD | POOR | POOR | POOR | POOR | POOR | POOR |
| HT AREA-A TRANSFERABILITY (DENSITY) | FAIR | GOOD | GOOD | GOOD | GOOD | FAIR | POOR |
| HT AREA-B TRANSFERABILITY (DENSITY) | GOOD | FAIR | POOR | POOR | POOR | POOR | POOR |
| SOLID IMAGE (BLACK) AREA-B TONER VOID | GOOD | GOOD | GOOD | GOOD | GOOD | GOOD | FAIR |
| SOLID IMAGE (BLACK) TRANSFERABILITY (DENSITY) | POOR | POOR | FAIR | GOOD | GOOD | GOOD | FAIR |
| SOLID IMAGE (BLUE) AREA-B TONER VOID | GOOD | GOOD | GOOD | GOOD | GOOD | GOOD | GOOD |
| SOLID IMAGE (BLUE) TRANSFERABILITY | POOR | POOR | POOR | POOR | GOOD | GOOD | GOOD |

FIG. 13

| PAPER | TABLE | |
|---|---|---|
| | AREA A | AREA B |
| PAPER A | 1 | 2 |
| PAPER B | 3 | 4 |
| PAPER C | 5 | 1 |

FIG. 14

| | COMPARATIVE EXAMPLE | | EMBODIMENT1 | | EMBODIMENT2 | | EMBODIMENT3 | | EMBODIMENT4 | |
|---|---|---|---|---|---|---|---|---|---|---|
| | DENSITY AT AREA A | TONER VOID AT AREA B | DENSITY AT AREA A | TONER VOID AT AREA B | DENSITY AT AREA A | TONER VOID AT AREA B | DENSITY AT AREA A | TONER VOID AT AREA B | DENSITY AT AREA A | TONER VOID AT AREA B |
| THICK SHEET A | GOOD | POOR | GOOD | GOOD | GOOD | GOOD | GOOD | GOOD | GOOD | GOOD |
| THICK SHEET B | GOOD | POOR | GOOD | FAIR | GOOD | GOOD | GOOD | GOOD | GOOD | FAIR |
| THICK SHEET C | GOOD | POOR | GOOD | FAIR | GOOD | FAIR | GOOD | GOOD | GOOD | FAIR |
| REGULAR SHEET A | GOOD | FAIR | GOOD | GOOD | GOOD | GOOD | GOOD | GOOD | GOOD | GOOD |
| REGULAR SHEET B | GOOD | FAIR | GOOD | FAIR | GOOD | GOOD | GOOD | GOOD | GOOD | FAIR |

IMAGE FORMING APPARATUS INCLUDING A TRANSFER BIAS CONTROLLER

CROSS-REFERENCE TO RELATED APPLICATIONS

This patent application is based on and claims priority pursuant to 35 U.S.C. §119 to Japanese Patent Application No. 2014-130253, filed on Jun. 25, 2014, in the Japan Patent Office, the entire disclosure of which is hereby incorporated by reference herein.

BACKGROUND

1. Technical Field

Exemplary aspects of the present disclosure generally relate to an image forming apparatus, such as a copier, a facsimile machine, and a printer.

2. Description of the Related Art

There is known an image forming apparatus that prevents image degradation due to a transfer failure such as insufficient transfer or overcharged transfer, by adjusting an electric current that flows in a transfer nip in accordance with an image area ratio.

SUMMARY

In view of the foregoing, in an aspect of this disclosure, there is provided an improved image forming apparatus including an image bearer with a surface to move, a toner image forming device to form a toner image on the surface of the image bearer based on image information, a transfer device to transfer the toner image from the image bearer onto a recording medium P in a transfer region with a transfer bias applied to the transfer region, a recording medium conveyor to deliver the recording medium to the transfer region while controlling an alignment of the recording medium that has entered the transfer region such that a trailing edge side of the recording medium relative to the transfer region is curved in alignment control, and a transfer bias controller to obtain information on a toner adhesion amount of a post-alignment-control toner image that passes through the transfer region after the recording medium is free from the alignment control, and to reduce the transfer bias after the alignment control is released to a level less than a level of the transfer bias that is applied when the toner image having a same toner adhesion amount passes through the transfer region before the recording medium is free from the alignment control, in a case in which a toner adhesion amount per unit area obtained from the information on the toner adhesion amount of the post-alignment-control toner image is less than a predetermined amount.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 7 is a table showing results of experiments to evaluate image quality of various images using different levels of secondary transfer current;

FIG. 13 is a table showing sheet types and corresponding control patterns during alignment control of a recording medium and when the recording medium is free from the alignment control; and FIG. 14 is a table showing results of effect verification experiments.

DETAILED DESCRIPTION

Figure 1:
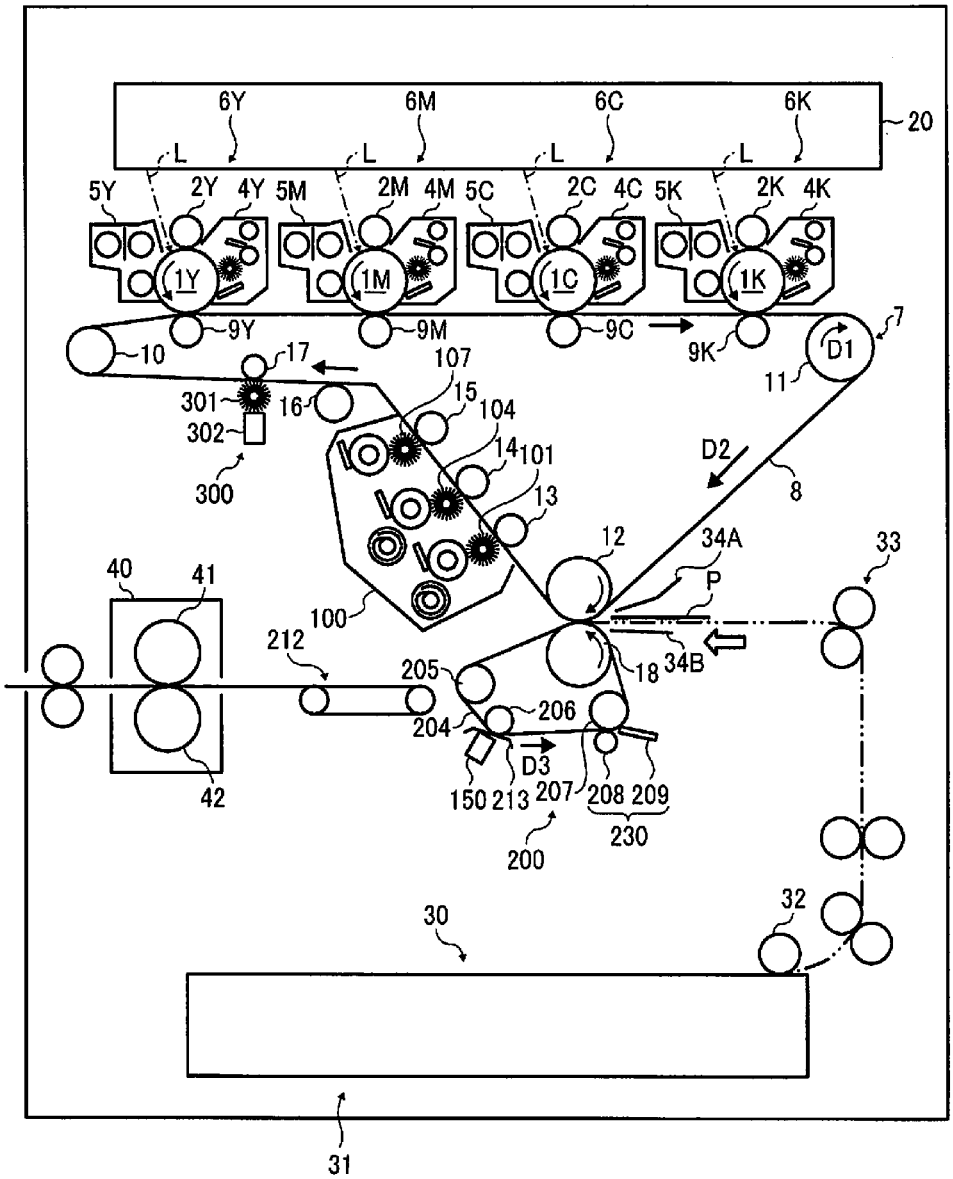
FIG. 1 is a schematic diagram illustrating a printer as an example of an image forming apparatus.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

In order to prevent image degradation due to transfer failure such as insufficient transfer or overcharged transfer, an electric current that flows during a transfer process may be adjusted in accordance with an image area ratio. For example, a target transfer current that flows through a transfer nip may be determined in accordance with an image area ratio. More specifically, a surface of a photoconductor may be segmented in a sub-scanning direction (i.e., a traveling direction of the surface of the photoconductor), each segment having ten (10) pixels, from the leading end of an image formation region. Each segment may include ten (10) lines of a pixel line consisting of a group of pixels arranged in the main scanning direction. For each pixel line, a ratio of pixels in an image portion to a total pixels may be obtained, and an average ratio of ten (10) pixel lines in each segment may be obtained as an image area ratio in one segment.

The target transfer current to be supplied at this time may be determined in accordance with the image area ratio corresponding to the segment of the image formation region that is passing through a transfer nip end (transfer region). In this configuration, while the image formation region is passing through the transfer nip end, the transfer current adjusted to the target value flows in the transfer nip. Because the optimal transfer current corresponding to the image area ratio of the image formation region passing through the transfer nip end flows, the transfer failure associated with the image area ratio may be prevented.

However, the quality of the trailing edge of a toner image may be degraded even when the transfer current to be supplied to the transfer region is adjusted in accordance with toner adhesion information such as the image area ratio of the toner image passing through the transfer region.

In general, in order to guide reliably various types of recording media with different thicknesses and materials, a sheet guide such as an entry guide may be disposed at an upstream side of the transfer region in a sheet transport direction. The trailing edge side of a recording medium with its leading end having entered the transfer region may be regulated by a sheet conveyor such as a pair of conveyor rollers and the sheet guide such as the entry guide, which makes the trailing edge side of the recording medium curled relative to the transfer region. As a result, when the recording medium passes through the sheet conveyor and the sheet guide and the trailing edge side of the recording medium is released, the trailing edge side of the recording medium may spring up due to its restoration force of the recording medium which has been curved.

When the trailing edge of the recording medium springs up, the distance between the image bearer and the recording medium may change abruptly at the upstream side of the transfer region in the sheet transport direction, generating an electrical discharge. When such an electrical discharge is generated, a portion of an image corresponding to the toner image present at the transfer region or at the upstream side of the transfer region in the traveling direction of the image bearer surface may include toner voids (absence of toner).

Furthermore, in a case of a recording medium having a relatively strong resilience such as a thick sheet, the trailing edge of the recording medium may spring up powerfully, thereby causing easily an electrical discharge and hence creating toner voids easily. It is supposed that the impact of electrical discharge disrupts the toner image at the trailing edge of the recording medium, resulting in voids at the trailing edge (trailing-edge toner voids). Furthermore, the electrical discharge may reverse the charge polarity of toner in the toner image to background toner or wrong sign toner. As a result, a significant amount of toner constituting the toner image cannot be transferred from the image bearer to the recording medium. The background toner or wrong sign toner herein refers to reversely charged toner.

In one example to prevent such toner voids at the trailing edge side of the recording medium (hereinafter referred to as trailing-edge toner voids), first, it is necessary to reduce curling of the trailing edge relative to the transfer region. Thus, the sheet conveyor including conveyor components and guide components may be optimized. However, there is a trade-off between efforts to reduce curling of the recording medium and efforts to reliably deliver various types of recording media. Consequently, it is difficult to optimize the configuration of the sheet conveyor while preventing the trailing-edge toner void.

In another example to prevent the trailing-edge toner void, the transfer bias may be reduced after the trailing edge of the recording medium is free from alignment control in a process referred to as a trailing-edge correction. With a reduced transfer bias, the difference in the electrical potential between the image bearer upstream from the transfer region in the sheet transport direction and the recording medium may be reduced, thereby increasing a degree of tolerance relative to the electrical discharge and suppressing the electrical discharge. In this approach, the electrical discharge that is generated after the regulation of the trailing edge side of the recording medium is released may be suppressed, hence preventing the trailing-edge toner void.

However, the present inventors have recognized that in the trailing-edge correction, while the reduced transfer bias is applied (after the trailing edge side of the recording medium is free from alignment control), if a large amount of toner is in the toner image at the transfer region, such as in a solid image, the transfer rate at the toner image portion drops, thereby causing a significant decrease in the image density of the image corresponding to the toner image.

Referring now to the drawings, wherein like reference numerals designate identical or corresponding parts throughout the several views, exemplary embodiments of the present patent application are described.

With reference to FIG. 1, a description is provided of a tandem-type printer using an intermediate transfer method as an example of an image forming apparatus according to an illustrative embodiment of the present disclosure.

FIG. 1 is a schematic diagram illustrating a printer as an example of an image forming apparatus according to illustrative embodiments of the present disclosure.

The image forming apparatus includes four process units 6Y, 6M, 6C, and 6K that form toner images of yellow, magenta, cyan, and black, respectively. It is to be noted that the suffixes Y, C, M, and K denote colors yellow, cyan, magenta, and black, respectively. To simplify the description, these suffixes are omitted herein, unless otherwise specified. The process units 6Y, 6M, 6C, and 6K include drum-shaped photoconductors 1Y, 1M, 1C, and 1K, respectively. The photoconductors 1Y, 1M, 1C, and 1K serve as image bearers. Charging devices 2Y, 2M, 2C, and 2K, developing devices 5Y, 5M, 5C, and 5K, photoconductor cleaners 4Y, 4M, 4C, and 4K, and charge removers are respectively provided around the photoconductors 1Y, 1M, 1C, and 1K. The process units 6Y, 6M, 6C, and 6K all have the same configuration as all the others, differing only in the color of toner employed.

An optical writing unit 20 that irradiates the photoconductors 1Y, 1M, 1C, and 1K with laser light L is disposed above the process units 6Y, 6M, 6C, and 6K.

An intermediate transfer unit 7 is disposed below the process units 6Y, 6M, 6C, and 6K. The transfer unit 7 includes an intermediate transfer belt 8 serving as an image bearer. The intermediate transfer belt 8 is formed into an endless loop. The intermediate transfer unit 7 further includes a plurality of tension rollers disposed inside the loop of the intermediate transfer belt 8, and a secondary transfer device 200, a tension roller 16, a belt cleaning device 100, and a lubricant applicator 300, which are disposed outside the loop of the intermediate transfer belt 8.

Inside the loop of the intermediate transfer belt 8, four primary transfer rollers 9Y, 9M, 9C, and 9K, a driven roller 10, a drive roller 11, a secondary-transfer opposed roller 12, three cleaning opposed rollers 13, 14, and 15, and an application-brush opposed roller 17 are disposed. The intermediate transfer belt 8 is entrained around these rollers and stretched taut. These rollers function as tension rollers. The cleaning opposed rollers 13, 14, and 15 do not necessarily apply a tension to the intermediate transfer belt 8 and may be driven to rotate along with rotation of the intermediate transfer belt 8. The drive roller 11 is driven to rotate clockwise indicated by an arrow D1 in FIG. 1 by a driving device such as a motor, and the intermediate transfer belt 8 is driven to travel endlessly clockwise indicated by arrow D2 in FIG. 1 by the rotation of the drive roller 11.

The intermediate transfer belt 8 is interposed between the photoconductors 1Y, 1M, 1C, and 1K, and the primary transfer rollers 9Y, 9M, 9C, and 9K disposed inside the looped intermediate transfer belt 8. The place where the peripheral surface or the front surface (image bearing surface) of the intermediate transfer belt 8 and the photoconductors 1Y, 1M, 1C, and 1K contact is a so-called primary nip. A primary transfer bias having a polarity opposite that of toner is applied from a power source to the primary transfer rollers 9Y, 9M, 9C, and 9K.

The secondary transfer device 200 as a transfer device disposed outside the looped intermediate transfer belt 8 includes a secondary transfer roller 18, a separation roller 205, an optical-detector opposed roller 206, a cleaning opposed roller 207, and a secondary transfer belt 204 serving as a transfer member as well as a second image bearer. 20S, 20Y, 20C, 20M, and 20K Outside the loop formed by the secondary transfer belt 204, an optical detector unit 150, and a secondary transfer cleaning device 230 are disposed. The optical detector unit 150 is disposed opposite to the optical-detector opposed roller 206 via the secondary transfer belt 204. The secondary transfer cleaning device 230 includes a cleaning brush 208 and a cleaning blade 209 which contact the secondary transfer belt 204 entrained about the cleaning opposed roller 207.

A shutter 213 is disposed between the optical detector unit 150 and the secondary transfer belt 204 to prevent an optical element of the optical detector unit 150 from getting contaminated by toner when the optical detector unit 150 is not in operation. The shutter 213 is turned on and off by a motor. According to the present illustrative embodiment, the shutter 213 is a mechanical shutter. Alternatively, the shutter may be a combination of an air shutter or the like.

The intermediate transfer belt 8 and the secondary transfer belt 204 are interposed between the secondary transfer opposed roller 12 disposed inside the looped intermediate transfer belt 8 and the secondary transfer roller 18. The place where the peripheral surface of the intermediate transfer belt 8 and the secondary transfer belt 204 contact is a so-called a secondary transfer nip. A secondary transfer bias having a polarity opposite that of toner is applied from a power source to the secondary-transfer opposed roller 12. Examples of material used for the secondary transfer belt 204 include, but are not limited to, polyimide, polyamide-imide, and polyvinylidene fluoride. In some embodiments, the secondary transfer belt 204 may employ an elastic belt.

The secondary transfer roller 18 is rotated counterclockwise by a drive source such as a drive motor in FIG. 1, thereby enabling the secondary transfer belt 204 to travel in the direction indicated by an arrow D3. The drive motor for driving the secondary transfer roller 18 may use a direct-current motor, a pulse motor, and the like.

The intermediate transfer belt 8 is interposed between the cleaning opposed rollers 13, 14, and 15, and cleaning brush rollers 101, 104, and 107, respectively. Accordingly, cleaning nips are formed at places where the cleaning brush rollers 101, 104, and 107 contact the peripheral surface of the intermediate transfer belt 8. The belt cleaning device 100 is replaceable together with the intermediate transfer belt 8. In a case in which the belt cleaning device 100 and the intermediate transfer belt 8 have different product life cycles, the belt cleaning device 100 may be detachably attachable relative to the main body of the image forming apparatus, independent of the intermediate transfer belt 8. A detailed description of the belt cleaning device 100 will be provided later.

The image forming apparatus of the present illustrative embodiment includes a paper feed unit 30 equipped with a paper cassette 31 and a feed roller 32. The paper cassette 31 stores a stack of recording media P. The feed roller 32 feeds the recording media P to a sheet passage. A pair of registration rollers 33 is disposed on the right side of the secondary transfer nip in FIG. 1. The pair of registration rollers 33 receives the recording medium P from the paper feed unit 30 and feeds it toward the secondary transfer nip at predetermined timing.

A fixing device 40 is disposed on the left side of the secondary transfer nip in FIG. 1 and includes a heating roller 41 and a pressing roller 42. The fixing device 40 receives the recording medium P bearing a toner image thereon from the secondary transfer nip and fixes the toner image on the recording medium P with heat and pressure applied by the heating roller 41 and the pressing roller 42. In some embodiments, the image forming apparatus optionally includes toner supply devices that supply toners of yellow, magenta, cyan, and black to the respective developing devices 5Y, 5M, 5C, and 5K, if necessary.

In addition to normal or regular paper, for example, special paper having an embossed surface or paper used for thermal transfer such as iron print may be used for the recording medium P. Improper transfer of color toner images superimposed one atop the other may occur more easily when transferring the toner images from the intermediate transfer belt 8 onto such special paper as compared with transferring the toner images onto normal paper. In view of the above, the intermediate transfer belt 8 includes an elastic layer with relatively low hardness on the surface that forms the transfer nip, thereby enabling the intermediate transfer belt 8 to deform in accordance with toner layers and a recording medium with a relatively rough surface.

The low-hardness elastic layer on the surface of the intermediate transfer belt 8 can deform in accordance with the surface condition of the intermediate transfer belt 8 which may be locally rough. With this configuration, the intermediate transfer belt 8 can closely contact the toner layer without applying excessive transfer pressure and can uniformly transfer the toner layer even onto a recording medium with a rough surface, hence preventing toner voids (blank spots) and achieving higher imaging quality.

According to the present illustrative embodiment, the intermediate transfer belt 8 includes, preferably, a base layer, an elastic layer on the base layer, and a surface coating layer disposed on the elastic layer. Examples of materials used for the elastic layer of the intermediate transfer belt 8 include, but are not limited to elastic members such as elastic material rubber and elastomer. Specific preferred materials suitable for the elastic layer include, but are not limited to, elastic rubbers and elastomers, such as butyl rubber, fluorine-based rubber, acrylic rubber, Ethylene Propylene Diene Monomer (EPDM), nitrile butadiene (NBR), acrylonitrile-butadiene-styrene rubber, natural rubber, isoprene rubber, styrene-butadiene rubber, butadiene rubber, urethane rubber, syndiotactic 1,2-polybutadiene, epichlorohydrin rubber, polysulfide rubber, polynorbornene rubber, and thermoplastic elastomers. These materials can be used alone or in combination.

The thickness of the elastic layer is preferably in a range of from 0.07 mm to 0.8 mm depending on the hardness and the layer structure of the elastic layer. More preferably, the thickness of the elastic layer is in a range of from 0.25 mm to 0.5 mm. When the thickness of the intermediate transfer belt 8 is small such as 0.07 mm or less, the pressure to the toner on the intermediate transfer belt 8 increases in the secondary transfer nip, and image defects such as toner voids (blank spots) occur easily during transfer. Consequently, the transferability of the toner is degraded. Preferably, the hardness of the elastic layer is $10° \leq HS \leq 65°$ in accordance with Japanese Industrial Standards (JIS-A). The optimal hardness differs depending on the layer thickness of the intermediate transfer belt 8. When the hardness is lower than 10° on JIS-A, toner voids occur easily during transfer. By contrast, when the hardness is higher than 65° on JIS-A, the belt is difficult to entrain around the rollers. Furthermore, the durability of such a belt with the hardness higher than 65° on JIS-A is poor because the belt is stretched taught for an extended period of time, causing frequent replacement of the belt.

The base layer of the intermediate transfer belt 8 is formed of relatively inelastic resin. More specifically, one or more materials selected from the following materials can be used. These materials include, but are not limited to polycarbonate, fluorocarbon resin (such as ETFE and PVDF), styrene-based resins (homopolymers and copolymers of styrene or styrene derivatives) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-ester acrylate copolymer (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-ester methacrylate copolymers (such as styrene-methyl methacrylate copolymer, styrene-ethyl methacrylate copolymer, and styrene-phenyl methacrylate copolymer), styrene-α-chloracryate methyl copolymer, and styrene-acrylonitrile acrylate ester copolymer, methyl methacrylate resin, butyl methacrylate resin, ethyl acrylate resin, butyl acrylate resin, modified acrylic resins (such as silicone-modified acrylic resin, vinyl-chloride-modified acrylic resin, and acrylic urethane resin), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, modified polyphenylene oxide resin. However, these materials are not limited thereto.

To prevent overstretching of the elastic layer made of a rubber material that easily stretches, a core layer made of a material such as canvas may be disposed between the base layer and the elastic layer. One or more materials selected from the following materials can be used for the core layer. These materials include, but are not limited to, natural fibers such as cotton and silk, synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber, and phenol fiber, carbon fiber, inorganic fiber such as glass fiber, and metal fibers such as iron fiber and copper fiber. These materials can be in a form of yarn or woven cloth.

However, the materials are not limited thereto. The yarn may consist of one filament or more filaments twisted together, a single-twist yarn, a plied yarn, and two-folded yarn, or any other suitable yarns. For example, fibers made of materials selected from the above material group may be mixed and spun. The yarn may be subjected to an appropriate conducting treatment. The woven cloth may be made by any weaving methods such as tricot weaving. Alternatively, the woven cloth may be made by combined weaving, and may be subjected to a conducting treatment.

The coating layer of the surface of the intermediate transfer belt 8 provides a smooth surface that covers the surface of the elastic layer. Any material can be used for the coating layer. However, materials that can enhance the transferability of the secondary transfer through reducing adhesion force of the toner onto the surface of the intermediate transfer belt 8 are generally used. Examples of materials used for the coating layer include, but are not limited to, polyurethane resin, polyester resin, epoxy resin, and combinations of two or more of the above-described materials.

Alternatively, a material that reduces surface energy to improve lubricating property, such as fluorocarbon resin grains, fluorine compound grains, carbon fluoride grains, titanium oxide grains, and silicon carbide grains with or without the grain size being varied may be used alone or in combination. The surface coating layer may also be a fluorine-containing layer formed by thermally treating a fluorine-containing rubber, thereby reducing surface energy of the layer.

In order to adjust resistance, each of the base layer, the elastic layer, and the surface coating layer may be formed of metal powder such as carbon black, graphite, aluminum, and nickel, conductive metal oxides such as tin oxide, titanium oxide, antimony oxide, indium oxide, potassium titanate, antimony-tin composite oxide (ATO), indium tin composite oxide (ITO), or the like. The conductive metal oxides may be covered with an insulative fine particles such as barium sulfate, magnesium silicate, or calcium carbonate, for example. However, these materials are not limited thereto.

The image forming apparatus of the present illustrative embodiment includes the lubricant applicator 300 to apply a lubricating agent on the surface of the intermediate transfer belt 8. The lubricant applicator 300 includes a brush roller 301 to contact and scrape a block (solid) lubricant 302 such as a block of zinc stearate while the brush roller 301 rotates. The lubricant in powder form thus obtained is applied to the surface of the intermediate transfer belt 8. Although the image forming apparatus of the present illustrative embodiment includes the lubricant applicator 300, the lubricant applicator 300 does not necessarily need to apply the lubricant 302 depending on a choice of toner, choice of the material of the intermediate transfer belt 8, and the friction coefficient of the surface of the intermediate transfer belt 8.

Next, a description is provided of copying operation of the image forming apparatus.

When receiving image information from a host machine such as a personal computer (PC) or the like, a controller 400 (shown in FIG. 2) of the image forming apparatus enables the drive roller 11 of the intermediate transfer unit 7 to rotate in a direction of arrow D1 in FIG. 1, thereby moving the intermediate transfer belt 8 in the direction of arrow D2 at a constant speed. The rollers other than the drive roller 11 around which the intermediate transfer belt 8 is entrained are rotated in conjunction with rotation of the intermediate transfer belt 8. A main motor drives the photoconductors 1Y, 1M, 1C, and 1K of the respective process units 6Y, 6M, 6C, and 6K to rotate in a direction of arrow at a constant speed. The surfaces of the photoconductors 1Y, 1M, 1C, and 1K are uniformly charged by the respective charging devices 2Y, 2M, 2C, and 2K. After the surfaces of the photoconductors 1Y, 1M, 1C, and 1K are charged, the photoconductors 1Y, 1M, 1C, and 1K are exposed to laser light L so that electrostatic latent images are formed on each of the photoconductors 1Y, 1M, 1C, and 1K.

The developing devices 5Y, 5M, 5C, and 5K develop the electrostatic latent images on the respective surfaces of the photoconductors 1Y, 1M, 1C, and 1K into respective toner images of yellow, magenta, cyan, and black. The toner images of yellow, magenta, cyan, and black are transferred onto an outer peripheral surface of the intermediate transfer belt 8 one atop the other in the respective primary transfer nips. Accordingly, a composite toner image, in which the toner images of yellow, magenta, cyan, and black are superimposed one atop the other, is formed on the outer peripheral surface of the intermediate transfer belt 8.

At the same time, in the paper feed unit 30, the feed roller feeds a sheet of recording medium P from the paper feed cassette 31 toward the pair of registration rollers 33. The recording medium P is transported until the leading end of the recording medium P is interposed between the pair of registration rollers 33. The pair of registration rollers 33 rotates to feed the recording medium P to the secondary transfer nip in the direction of arrow a in appropriate timing such that the recording medium P is aligned with the four-color composite toner image formed on the intermediate transfer belt 8 in the secondary transfer nip. Because an electrical field that causes the toner to move from the intermediate transfer belt 8 to the recording medium P is formed in the secondary transfer nip, the composite toner image on the intermediate transfer belt 8 is transferred onto the recording medium P when the recording medium P passes through the secondary transfer nip.

Thus, the composite full-color toner image is formed on the recording medium P. After the secondary transfer, the recording medium P is electrostatically absorbed to the secondary transfer belt 204 and carried thereon in the traveling direction of the secondary transfer belt 204. The recording medium P electrostatically adhering to the secondary transfer belt 204 separates from the secondary transfer belt 204 by self stripping at the separation roller 205 and is delivered to a belt conveyor 212. The belt conveyor 212 then carries the recording medium P and delivers to the fixing device 40. After the fixing process, the recording medium P, on which the toner image is fixed, is output by a pair of output rollers onto a catch tray outside the image forming apparatus.

After the toner images of yellow, magenta, cyan, and black are transferred primarily from the photoconductors 1Y, 1M, 1C, and 1K onto the intermediate transfer belt 8, the photoconductor cleaners 4Y, 4M, 4C, and 4K remove residual toner remaining on the respective photoconductors 1Y, 1M, 1C, and 1K. Subsequently, charge removers such as charge erasing lamps eliminate electric charges remaining on the photoconductors 1Y, 1M, 1C, and 1K. Then, the photoconductors 1Y, 1M, 1C, and 1K are again charged uniformly by the respective charging devices 2Y, 2M, 2C, and 2K in preparation for the subsequent imaging cycle. After the composite toner image is transferred from the intermediate transfer belt 8 onto the recording medium P in the secondary transfer process, the belt cleaning device 100 removes residual toner remaining on the intermediate transfer belt 8 and the lubricant applicator 300 applies the lubricating agent to the intermediate transfer belt 8. The cleaning brush 208 and the cleaning blade 209 clean the surface of the secondary transfer belt 204.

As described above, according to the present illustrative embodiment, in order to transfer the toner images reliably onto a recording medium with a rough surface or embossed surface, the intermediate transfer belt 8 employs an elastic belt. An example of such an elastic intermediate transfer belt includes a base layer as an innermost layer, an elastic layer disposed on the base layer, and a coating layer as a surface layer disposed on the elastic layer. The thickness of the base layer is in a range of from 50 μm to 100 p.m. Materials for the base layer include, but are not limited to polyamide-imide and polyimide. The elastic layer employs an acrylic rubber or the like disposed on the base layer. The coating layer provides releasing properties on the surface layer. In general, the elastic layer has a thickness in a range of from 100 μm to 1 mm. In accordance with the belt characteristics such as elasticity and hardness of the elastic intermediate transfer belt 8, a proper pressure is applied in the secondary transfer nip, thereby transferring reliably the toner onto recessed portions of the surface of the recording medium with a rough surface.

With the use of such an elastic intermediate transfer belt, it is necessary to apply adequate pressure to the elastic layer. Thus, a relatively high transfer pressure is required in the secondary transfer nip. For example, a plurality of pressuring devices may be employed to change the secondary transfer pressure in accordance with the recording medium. However, application of a relatively high secondary transfer pressure causes the recording medium P and the intermediate transfer belt 8 to contact tightly, which results in improper separation of the recording medium P form the intermediate transfer belt 8. That is, the recording medium P that has passed through the secondary transfer nip does not separate from the intermediate transfer belt 8 properly. This problem is more pronounced in a roller transfer method in which a roller-type secondary transfer device is pressed against the intermediate transfer belt 8.

In view of the above, according to the illustrative embodiments of the present disclosure, a belt transfer method is employed as the secondary transfer device 200. In the belt transfer method, when the recording medium P passes through the secondary transfer nip, an adsorption force acts on the recording medium P relative to the secondary transfer belt 204. The absorption force is stronger than the absorption force relative to the intermediate transfer belt 8. Thus, the recording medium P is separated from the intermediate transfer belt 8 more easily. Therefore, with the use of the belt transfer method together with the elastic intermediate transfer belt 8, it is possible to secure reliably both transferability and separability for a variety of recording media such as thin paper and thick paper.

According to the present illustrative embodiment, a combination of the elastic intermediate transfer belt 8 and the belt transfer method is employed in the image forming apparatus. However, the present disclosure is not limited thereto. For example, the intermediate transfer belt may be an inelastic belt made of polyimide or the like, or the roller transfer method may be employed.

Next, a description is provided of the transfer current control according to an illustrative embodiment of the present disclosure.

Figure 2:
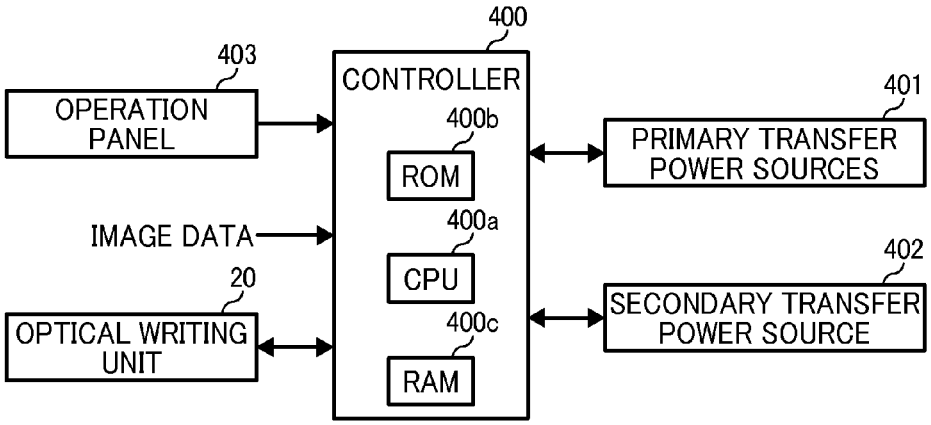
FIG. 2 is a block diagram illustrating a portion of an electrical circuit of the image forming apparatus of FIG. 1 according to an illustrative embodiment of the present disclosure.

FIG. 2 is a block diagram illustrating a portion of an electrical circuit of the image forming apparatus according to an illustrative embodiment of the present disclosure.

As illustrated in FIG. 2, the controller 400 includes a Central Processing Unit (CPU) 400*a* serving as a computing device, a Random Access Memory (RAM) 400*c* serving as a nonvolatile memory, and a Read Only Memory (ROM) 400*b* serving as a temporary storage device, and so forth. The controller 400 that controls the entire image forming apparatus is connected operatively to a variety of devices and sensors via signal lines. The controller 400 serves also as a transfer bias controller.

Figure 4:
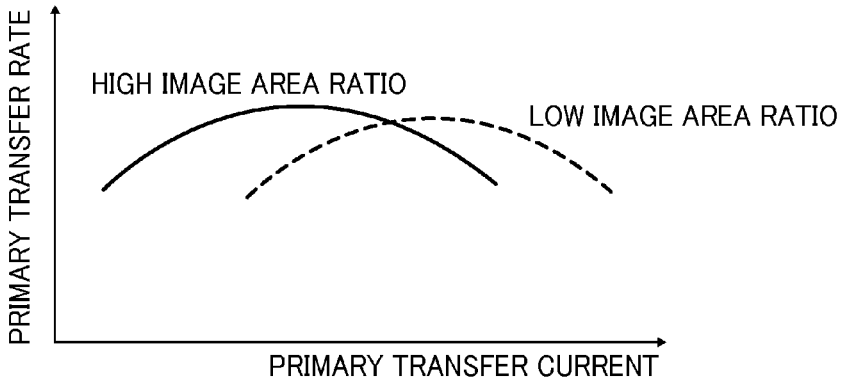
FIG. 4 is a graph showing relations between the primary transfer current and a primary transfer rate when an image area ratio is relatively high and when an image area ratio is relatively low.

For simplicity, FIG. 4 illustrates only the devices associated with the characteristic configuration of the image forming apparatus of the illustrative embodiments of the present disclosure. Based on a control program stored in the RAM 400*c* and a ROM 400*b*, the controller 400 drives each device including primary transfer power sources 401 for the colors yellow, cyan, magenta, and black, and a secondary transfer power source 402.

More specifically, upon latent image formation, the controller 400 determines a primary transfer current for each color in accordance with a write signal generated based on image information (image data) provided by a host machine such as a personal computer, and controls each of the primary transfer power sources 401 to obtain the determined primary transfer current in a transfer current control. Furthermore, based on the write signal, the controller 400 determines a secondary transfer current for each color, and controls the secondary transfer power source 402 to obtain the determined secondary transfer current in the transfer current control.

Figure 3A:
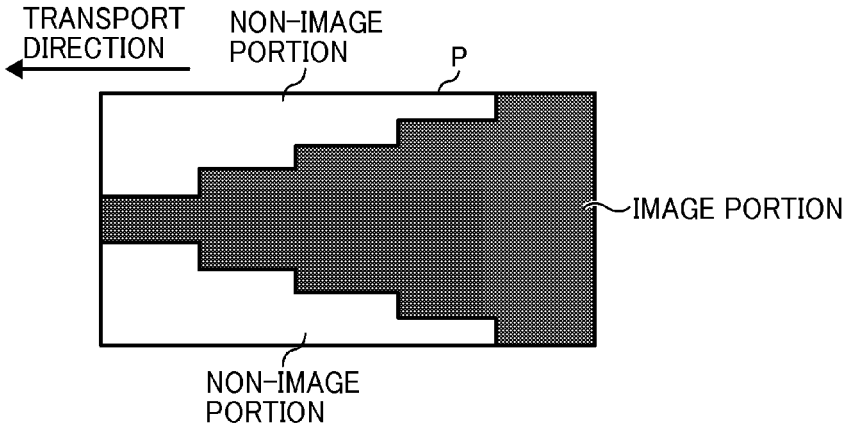
FIG. 3A is a conceptual diagram illustrating an example of image information.
Figure 3B:
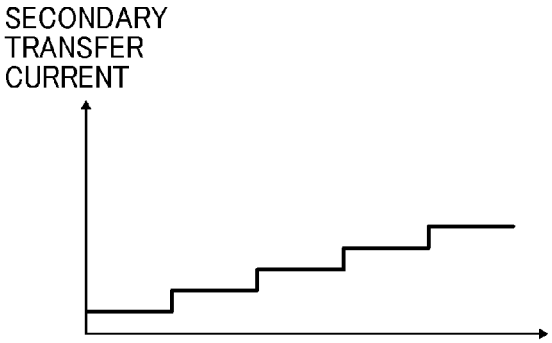
FIG. 3B is a graph showing an example of a target secondary transfer electric current (secondary transfer current) that is determined in accordance with the image information shown in FIG. 3A.
Figure 3C:
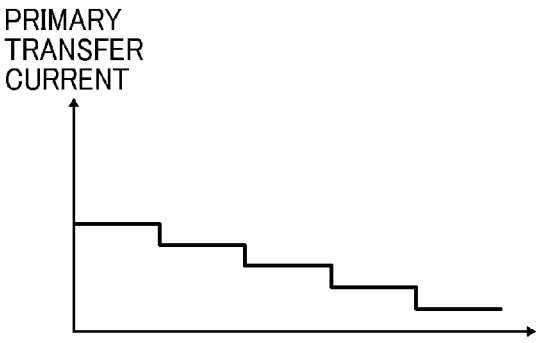
FIG. 3C is a graph showing an example of a target primary transfer electric current (primary transfer current) that is determined in accordance with the image information shown in FIG. 3A.

FIG. 3A is a conceptual diagram to explain the image information. FIG. 3B is a graph showing an example of a target secondary transfer electric current (secondary transfer current) that is determined in accordance with the image information shown in FIG. 3A. FIG. 3C is a graph showing an example of a target primary transfer electric current (primary transfer current) that is determined in accordance with the image information shown in FIG. 3A.

The image information shown in FIG. 3A corresponds to an image having an image area ratio in the main scanning direction that increases gradually from the leading end in a direction of sheet conveyance. According to the present illustrative embodiment, as illustrated in FIG. 3C, the target primary transfer current is set such that the lower is the image area ratio of a toner image passing through the primary transfer nip, the greater is the primary transfer current. By contrast, as illustrated in FIG. 3B, the target secondary transfer current is set such that the lower is the image area ratio of a toner image passing through the secondary transfer nip, the lower is the primary transfer current.

FIG. 4 is a graph that compares relations between the primary transfer current and a primary transfer rate when an image area ratio is relatively high and when an image area ratio is relatively low.

As illustrated in FIG. 4, in the primary transfer process, the rise time of the primary transfer rate relative to the primary transfer current is faster when the image has a relatively high image area ratio than when the image area ratio is relatively low. The primary transfer rate peaks at the lower primary transfer current side. The reason is as follows. In the primary transfer nip, the potential of a non-image portion (background portion) of the photoconductors 1Y, 1M, 1C, and 1K is higher than the potential of an image portion of the photoconductors 1Y, 1M, 1C, and 1K. The non-image portion refers to a region to which no toner is adhered. The image portion refers to a region to which toner is adhered. This means that when the non-image portion is relatively large, that is, the image area ratio is low, the primary transfer current flows more into the non-image portion in the primary transfer nip. In other words, the amount of primary transfer current that flows into the image portion is reduced.

In view of the above, based on the image information, the controller 400 obtains information on the toner adhesion amount (information on the image area ratio and so forth) at each toner image portion corresponding to the image information in the moving direction of the surface of the photoconductor. Subsequently, the controller 400 controls the primary transfer power source 401 in the transfer current control such that the primary transfer current that flows when each toner image portion passes through the primary transfer nip changes in accordance with the information on the toner adhesion amount at the toner image portion.

Figure 5:
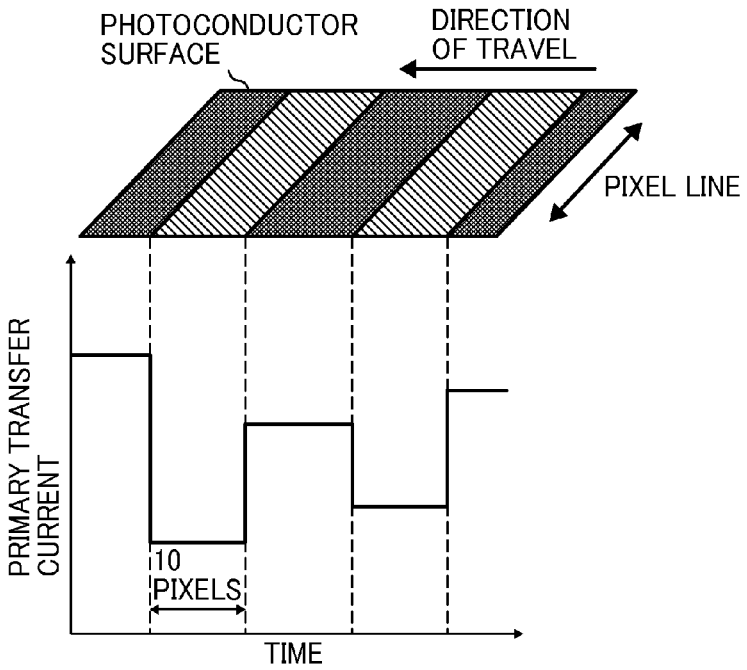
FIG. 5 is a conceptual diagram for explaining segmentation of a toner image.

More specifically, as illustrated in FIG. 5, for example, the surface of the photoconductor 1 in the sub-scanning direction (i.e., a moving direction of the surface of the photoconductor) is segmented into a plurality of segments, each segment having 10 pixels, from the leading end of the image formation region. Accordingly, each segment includes, in the main scanning direction, 10 lines of a pixel line consisting of a group of pixels arranged linearly. For each pixel line, a ratio of pixels in the image portion to the total pixels is obtained as the image area ratio of each pixel line. An average ratio of 10 pixel lines in each segment (i.e., an average image area ratio of each segment) is obtained as the toner adhesion amount information for each segment.

Subsequently, the target primary transfer current to be supplied when the toner image portion corresponding to each segment passes through the primary transfer nip is determined in accordance with the toner adhesion amount information for the corresponding segment (the average image area ratio for the corresponding segment). With this configuration, during which the toner image portion corresponding to each segment is passing through the primary transfer nip, an output voltage (i.e., primary transfer bias) from the primary transfer power sources 401 is adjusted such that the transfer current having the same value as the target primary transfer current flows.

Figure 6:
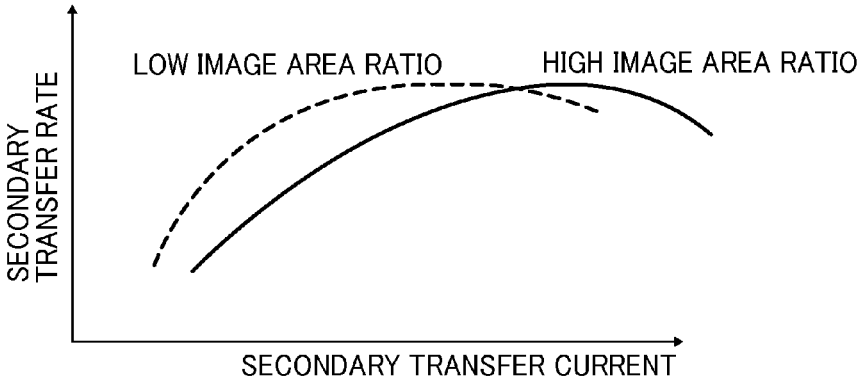
FIG. 6 is a graph showing relations between the secondary transfer current and a secondary transfer rate when an image area ratio is relatively high and when an image area ratio is relatively low.

FIG. 6 is a graph that compares relations between the secondary transfer current and the secondary transfer rate when the image area ratio is relatively high and when the image area ratio is relatively low.

As illustrated in FIG. 6, in the secondary transfer process, the rise time of the secondary transfer rate relative to the secondary transfer current is faster when the image has a relatively high image area ratio than when the image area ratio is relatively low. The secondary transfer rate peaks at the lower secondary transfer current side. In the secondary transfer process, the greater is the amount of toner that is present in the secondary transfer nip, the more secondary transfer current is needed.

In view of the above, based on the image information, the controller 400 obtains information on the toner adhesion amount (information on the image area ratio and so forth) at each toner image portion on the intermediate transfer belt 8 corresponding to the image information in the traveling direction of the intermediate transfer belt 8. Subsequently, the controller 400 controls the secondary transfer power source 402 in the transfer current control such that the secondary transfer current that flows when each toner image portion passes through the secondary transfer nip changes in accordance with the information on the toner adhesion amount at the toner image portion.

More specifically, as illustrated in FIG. 5, the average image area ratio for each segment consisting of ten pixels is obtained as the toner adhesion amount information for each segment. Subsequently, the target secondary transfer current to be supplied when the toner image portion corresponding to each segment passes through the secondary transfer nip is determined in accordance with the toner adhesion amount information for the corresponding segment (the average image area ratio for the corresponding segment). With this configuration, while the toner image portion corresponding to each segment is passing through the secondary transfer nip, an output voltage (i.e., secondary transfer bias) from the secondary transfer power source 402 is adjusted such that the transfer current having the same value as the target primary transfer current flows.

However, despite such a transfer current control, there is a case in which image quality is degraded near the trailing edge of the toner image. More specifically, in general, in order to reliably guide different types of recording media, for example, recording media having different thicknesses and materials, an entry guide is disposed upstream from the secondary transfer nip in the direction of sheet conveyance. Similarly, in the present illustrative embodiment as illustrated in FIG. 1, an upper entry guide 34A and a lower entry guide 34B are disposed upstream from the secondary transfer nip in the direction of sheet conveyance. The upper entry guide 34A guides an upper surface of the recording medium P. The lower entry guide 34B guides a lower surface of the recording medium P.

The trailing edge side of the recording medium P with its leading edge entered in the secondary transfer nip is controlled by the upper entry guide 34A and the lower entry guide 34B in alignment control. Thus, a portion of the recording medium upstream from the secondary transfer nip in the direction of sheet conveyance is curved. In this configuration, when the recording medium P passes through the upper entry guide 34A and the lower entry guide 34B and hence the trailing edge of the recording medium P is free from the alignment control, the trailing edge side of the recording medium P springs up due to the restoration force of the recording medium P. As a result, the distance between the intermediate transfer belt 8 and the recording medium P changes abruptly at the upstream side of the secondary transfer nip in the direction of sheet conveyance, hence generating an electrical discharge.

The electrical discharge causes degradation of image quality such as dropouts of toner or toner voids at a toner image portion that passes through the secondary transfer nip after the trailing edge of the recording medium P is free from the alignment control. This particular portion of the toner image passing through the secondary transfer nip after the trailing edge of the recording medium P is free from the alignment control is hereinafter referred to as a post-alignment-control toner image. This dropout of toner is hereinafter referred to as a trailing-edge toner void. In particular, the trailing-edge toner void is more pronounced when using recording media with strong resilience such as thick paper.

It is possible to prevent the trailing-edge toner void by devising the shape and arrangement of the upper entry guide 34A and the lower entry guide 34B. More specifically, guide planes of the upper entry guide 34A and the lower entry guide 34B are disposed parallel to the surface of the recording medium P that enters the secondary transfer nip. Accordingly, the recording medium P is curved less, hence reducing the force of the trailing edge side of the recording medium that springs up when the trailing edge side of the recording medium is free from the alignment control by the upper entry guide 34A and the lower entry guide 34B. However, in this configuration, the recording medium P with small resilience such as thin paper is difficult to feed into the secondary transfer nip, hence degrading conveyance ability.

There is a trade-off between efforts to reduce curling of the recording medium and efforts to reliably deliver various types of recording media. Thus, it is difficult to optimize the shape and arrangement of the upper entry guide 34A and the lower entry guide 34B to prevent the trailing-edge toner void while delivering reliably the recording media.

FIG. 7 is a table showing results of experiments performed by the present inventors to evaluate the image quality using different levels of secondary transfer current.

In the experiments, the image forming apparatus having the similar configuration to the image forming apparatus of the illustrative embodiment was used. The following images were formed with different levels of the primary transfer current. Halftone (HT) image with the image area ratio of approximately 25%; Solid black image with the image area ratio of approximately 100%; Solid black image with the image area ratio of approximately 200%; and Solid blue image. The following parameters were evaluated: Trailing-edge toner void in the post-alignment-control toner image after the recording medium P is free from the alignment control; Transferability until the recording medium P is free from the alignment control (i.e., Area-A transferability which is transferability at an area other than the trailing edge (Area B) of the recording medium P, and Transferability (Area-B transferability) at the trailing edge side (Area B) of the image after the recording medium P is free from the alignment control. Each of the parameters was graded as "GOOD" when the image degradation was within a permissible range, "FAIR" when the image degradation was out of the permissible range, but not significant, and "POOR" when the image degradation was significant.

The post-alignment-control image portion refers to an image portion corresponding to a toner image that passes through the secondary transfer nip after the recording medium P is free from the alignment control, that is, after the recording medium P passes through the upper entry guide 34A and the lower entry guide 34B. More specifically, the post-alignment-control image portion is an image portion located approximately 15 mm from the trailing edge of the recording medium according to the present illustrative embodiment.

As illustrated in FIG. 7, in order to bring the trailing-edge toner void of the halftone image within the permissible range, the secondary transfer current needs to be set to equal to or less than 20 μA. However, with the secondary transfer current not greater than 20 μA, the Area-A transferability (i.e., the secondary transfer rate) is worsened, and the image density near the center of the halftone image is lower than the target image density. By contrast, even when the secondary transfer current is equal to or less than 20 μA, the trailing-edge transferability (i.e., the secondary transfer rate) can maintain the target image density.

The reason is supposed that because the orientation of the recording medium P is different before and after the recording medium P is free from the regulation by the upper entry guide 34A and the lower entry guide 34B, the required secondary transfer current for proper transfer changes accordingly. More specifically, since an electrical discharge occurs near the image at the trailing edge of the recording medium even with a low secondary transfer current, it is supposed that the optimal value of the secondary transfer current shifts towards a very small value.

Next, with regards to the evaluation of the solid black image, as illustrated in FIG. 7, with the secondary transfer current equal to or less than 120 μA, the trailing-edge toner void is within the permissible range. However, in order to secure an adequate image density, the secondary transfer current needs to be not less than 80 μA and not greater than 120 μA. Similarly, with regards to the evaluation of the solid blue image, as illustrated in FIG. 7, the trailing-edge toner void does not occur throughout the secondary transfer current employed in the experiment. However, in order to secure an adequate image density, the secondary transfer current needs to be equal to or greater than 100 μA. With regards to both the halftone image and the solid image, if the secondary transfer current is too large, overcharged transfer occurs, causing a decrease in the transfer rate and hence reducing the image density.

It is to be noted that since the solid black image is formed only with a black toner image, the black toner image having an image area ratio of 100% is secondarily transferred onto a recording medium P in the secondary transfer nip. By contrast, the solid blue image is formed such that a magenta toner image having an image area ratio of 100% and a cyan toner image having an image area ratio of 100% are superimposed one atop the other, forming a composite toner image (i.e., a toner image having an image area ratio of 200%) and transferred secondarily in the secondary transfer nip. Therefore, as compared with the solid black image, for the solid blue image the amount of toner in the secondary transfer nip is greater than that of the solid black image, hence requiring more secondary transfer current.

In a case in which the transfer current control is carried out using the results of the evaluation shown in FIG. 7, the target secondary transfer current is determined such that, for example, when the toner image has an image area ratio of 200% the target transfer current is 100 μA. When the toner image has an image area ratio of 100%, the target secondary transfer current is 80 μA. When the toner image has an image area ratio of 25%, the target secondary transfer current is 40 μA.

Figure 8:
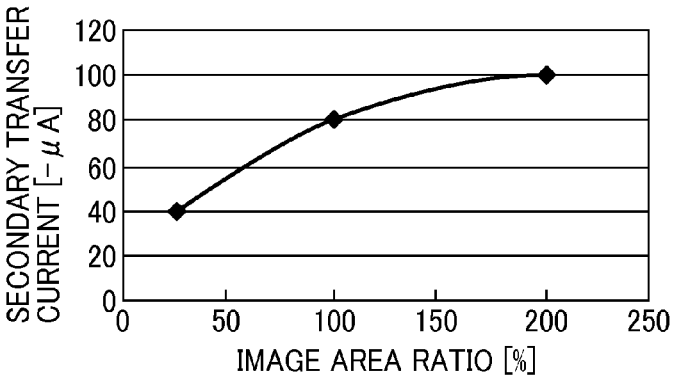
FIG. 8 is a graph showing relations between the image area ratio and the target secondary transfer current.

In summary, the relations between the image area ratio and the target secondary transfer current are shown in FIG. 8.

In FIG. 8, an optimal secondary transfer current for each of the image area ratios 200%, 100%, and 25% obtained from the results of the experiments shown in FIG. 7 is plotted and approximated by a quadratic function. Good image density reproducibility can be achieved over the entire image by storing, in the ROM 400*b* of the controller 400, a control table representing information on the correlation between the image area ratio and the target secondary transfer current such as shown in FIG. 8, and changing the target secondary transfer current in accordance with the image area ratio obtained from the image information based on the control table.

However, in a case in which the transfer current control is carried out, if the toner image that passes through the upper entry guide 34A and the lower entry guide 34B and then through the secondary transfer nip after the trailing edge of the recording medium P is free from the alignment control is a halftone image (for example, an image with an image area ratio of approximately 25%), the secondary transfer current after the trailing edge of the recording medium P is free from the alignment control is 40 μA, causing the trailing-edge toner voids.

In order to prevent the trailing-edge toner voids, for example, the target secondary transfer current is decreased or increased after the recording medium P is free from the alignment control in the trailing-edge correction. More specifically, in one example, before the recording medium P is released from the alignment control, the target secondary transfer current is determined in accordance with the control table based on the correlation information shown in FIG. 8. However, after the recording medium P is released from the alignment control, half the secondary transfer current that is obtained from the control table is set as the target secondary transfer current.

In this case, if the toner image that is secondarily transferred after the recording medium P is free from the alignment control is a halftone image (for example, an image with an image area ratio of approximately 25%), the target secondary transfer current is 20 μA (that is, 20 μA=40 μA×½), thereby preventing the trailing-edge toner voids as illustrated in FIG. 7.

However, if such a trailing-edge correction is performed regardless of an image area ratio, for example, the target secondary transfer current is 50 μA (that is, 50 μA=100 μA×½) when the toner image that is secondarily transferred after the alignment control is a solid blue image (for example, an image with an image area ratio of approximately 200%). In this case, as illustrated in FIG. 7, the secondary transfer rate drops, and hence the target image density cannot be obtained.

Figure 9:
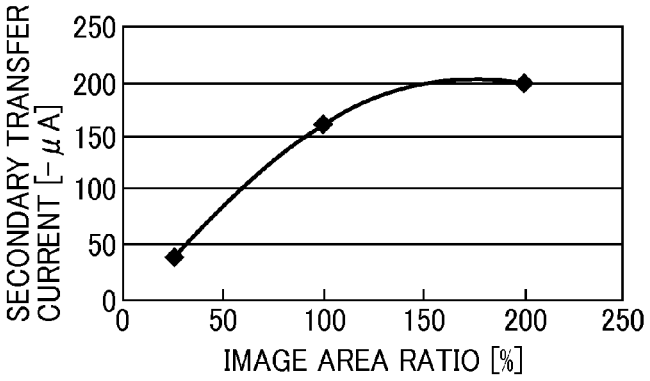
FIG. 9 is a graph showing relations between the image area ratio and the target secondary transfer current after the target secondary transfer current is adjusted.

In order to prevent inadequate image density when forming a solid blue image, as illustrated in FIG. 9, the target secondary transfer current is preset to 200 μA when the image area ratio is 200%. With this configuration, even when the above-described trailing-edge correction is performed, the target secondary transfer current is 100 μA (that is, 100 μA=200 μA×½), hence preventing inadequate image density at the trailing edge side of the image.

However, with the image area ratio of 100%, increasing the target secondary transfer current in advance to prevent inadequate image density in the trailing-edge correction causes the Area-A transferability (secondary transfer rate) to drop before the trailing-edge correction (i.e., before the recording medium P is free from the alignment control) due to overcharged transfer. As a result, the image density of the image before the trailing-edge correction is inadequate.

For example, as illustrated in FIG. 9, in a case in which the image area ratio is 100%, when the target secondary transfer current is set to 160 μA in advance so as to achieve 80 μA for the target secondary transfer current in the trailing-edge correction, the transferability (secondary transfer rate) before the trailing-edge correction drops due to overcharged transfer. As a result, the image density of the image before the trailing-edge correction is inadequate.

In a case in which the image area ratio is 100%, even when inadequate image density can be prevented with the target secondary transfer current of 160 μA, as illustrated in FIG. 9, the range in which the secondary transfer current is changed in accordance with the image area ratio is significantly wide. When the range in which the secondary transfer current changes is wide, it is difficult to supply an appropriate secondary transfer current at an appropriate time due to a difficulty in tracking capability relative to the setting value of the secondary transfer power source. As a result, the image density reproducibility by the transfer current control is degraded. In view of the above, preferably, the range in which the secondary transfer current changes relative to the image area ratio is narrow.

Figure 10:
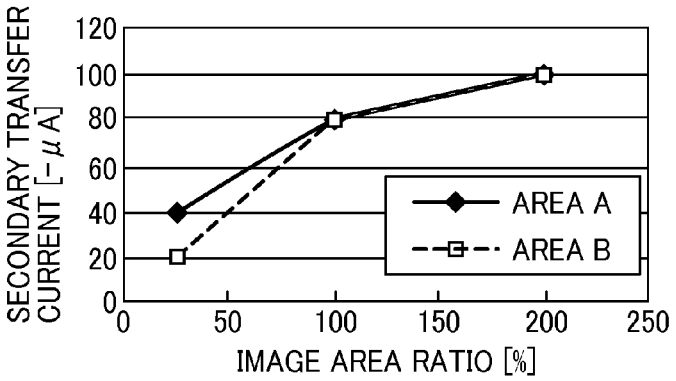
FIG. 10 is a graph showing relations between the image area ratio and the target secondary transfer current employed in a transfer current control according to an illustrative embodiment of the present disclosure.

FIG. 10 is a graph showing relations between the image area ratio and the target secondary transfer current employed in the transfer current control according to an illustrative embodiment of the present disclosure.

According to the present illustrative embodiment, two kinds of control tables are used as the control table (i.e., correlation information between the image area ratio and the target secondary transfer current) for the transfer current control. That is, a first control table (i.e., first correlation information) is used in the transfer current control until the recording medium P is free from the alignment control, and a second control table (i.e., second correlation information) is used in the transfer current control after the recording medium P is free from the alignment control.

More specifically, until the recording medium P is free from the alignment control, the transfer current control is performed using the control table represented in a bold line in FIG. 10 which is similar to or the same control table as the control table shown in FIG. 8. With this configuration, high image density reproducibility can be reliably achieved regardless of the image area ratio for the image portion that is secondarily transferred before the regulation of the recording medium P is released.

After the regulation of the recording medium P is released, the transfer current control is performed using the control table represented in a fine line shown in FIG. 10. When the image area ratio of the toner image (specified toner image portion) that is in the secondary transfer nip or at the upstream side of the secondary transfer nip in the direction of travel of the intermediate transfer belt 8 is equal to or greater than 100% after the recording medium P is free from the alignment control, the control table is similar to or the same control table as the control table until the recording medium P is free from the alignment control. With this configuration, when the image area ratio of the toner image is equal to or greater than 100%, high image density reproducibility can be achieved while preventing the trailing-edge toner voids. By contrast, in a case in which the image area ratio is less than 100%, the target secondary transfer current to be set is less relative to the control table until the recording medium is free from the alignment control. With this configuration, when the image area ratio of the toner image is less than 100%, high image density reproducibility can be reliably achieved while preventing the trailing-edge toner voids.

According to the present illustrative embodiment, the same target secondary transfer current is set before and after the recording medium P is free from the alignment control when the image area ratio is equal to or greater than 100%. Alternatively, in some embodiment, when the image area ratio is equal to or greater than 100%, the target secondary transfer current may be changed before and after the recording medium P is free from the alignment control.

According to the present illustrative embodiment, the image area ratio of 100% is considered as the threshold, and the target secondary transfer current is reduced when the image area ratio is less than the threshold. Alternatively, the threshold can be changed as needed.

Figure 11A:
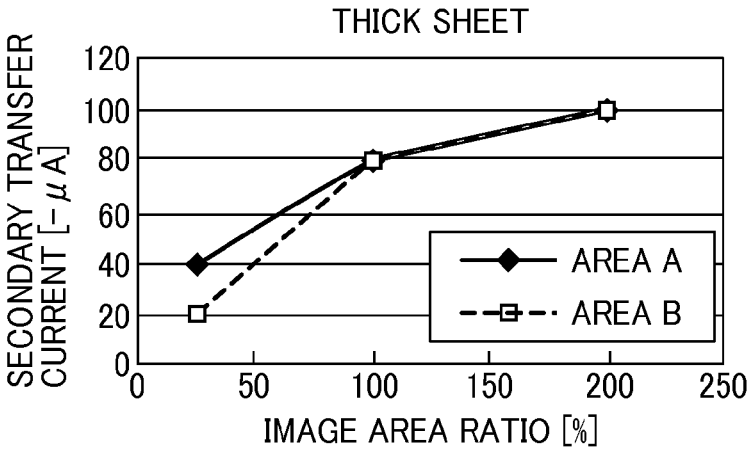
FIG. 11A is a graph showing relations between the image area ratio and the target secondary transfer current employed in the transfer current control when forming an image on a relatively thick sheet.
Figure 11B:
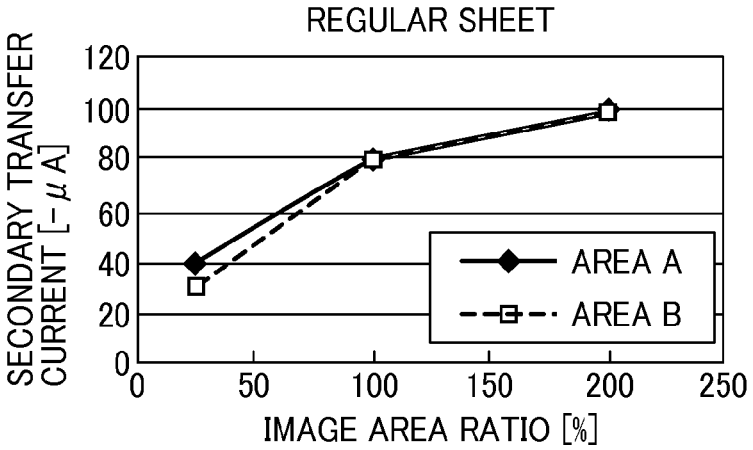
FIG. 11B is a graph showing relations between the image area ratio and the target secondary transfer current employed in the transfer current control when forming an image on a regular sheet.
Figure 12A:
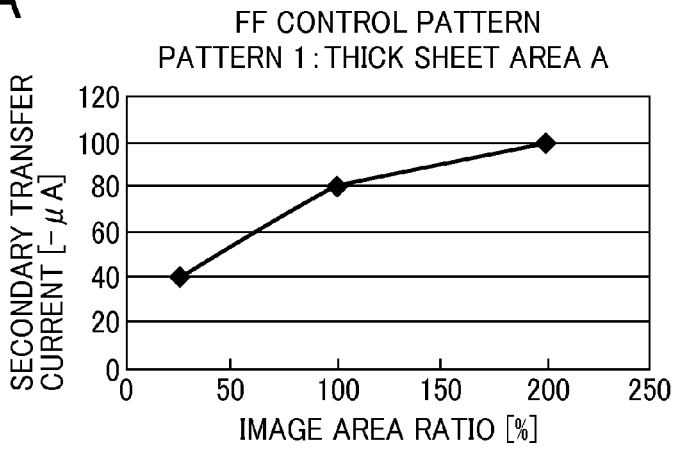
FIGS. 12A through 12F are examples of control tables for patterns 1 through 6 employed in the transfer current control.
Figure 12B:
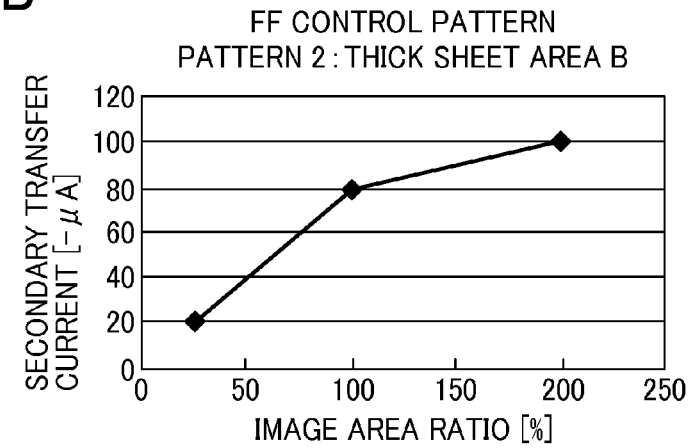
Figure 12C:
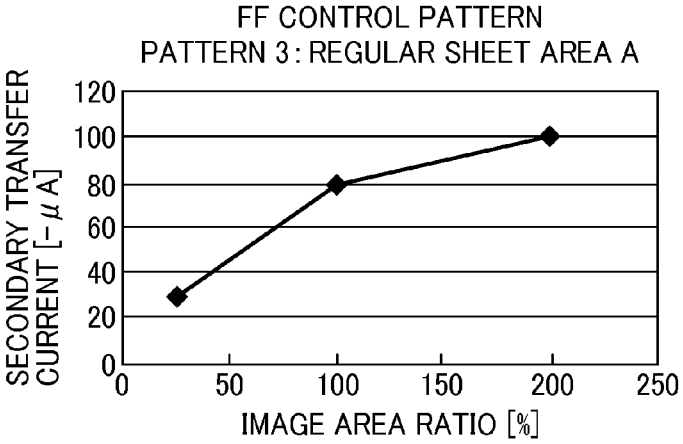
Figure 12D:
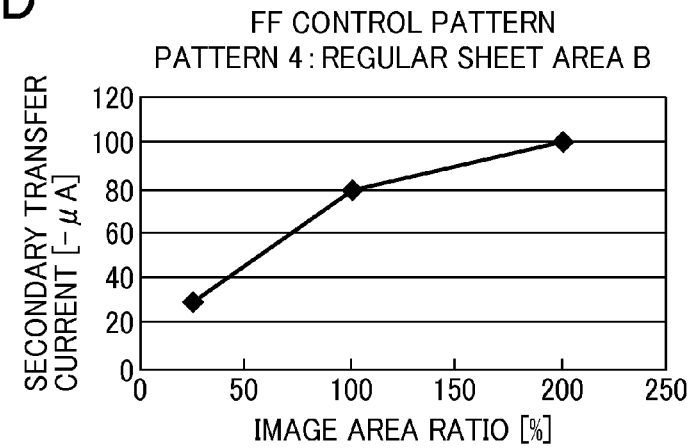
Figure 12E:
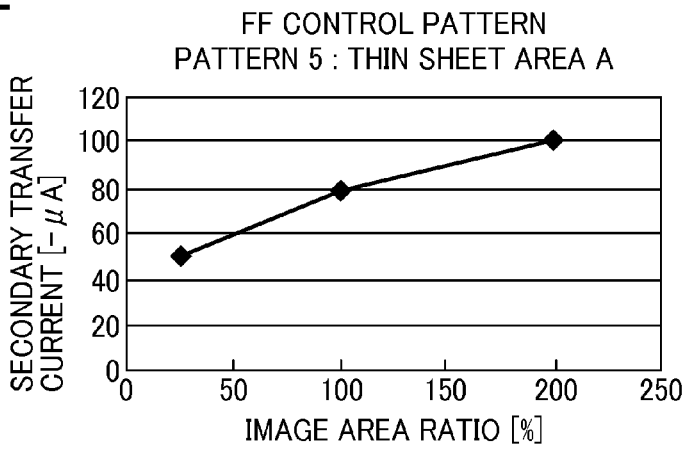
Figure 12F:
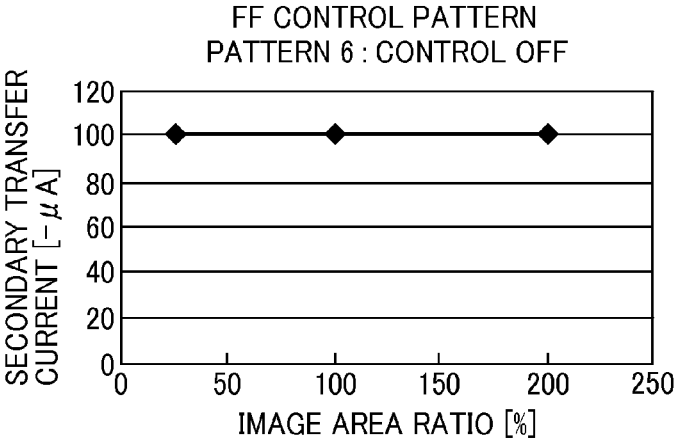

The secondary transfer current that causes the trailing-edge toner voids or high image density reproducibility differs depending on a thickness and material of a recording medium P. Therefore, depending on the information on the type of the recording medium P, one of the control tables before and after the recording medium P is free from the alignment control may employ a different control table. For example, when the recording medium has a sheet bases weight greater than 120 grams per square meter (gsm), i.e., thick paper, the control table such as shown in FIG. 11A is used. When the recording medium has a sheet bases weight of 120 gsm or less, i.e., regular paper, the control table such as shown in FIG. 11B is used. With more than three control tables, more suitable transfer current control can be performed for different types of recording media.

Methods for identifying types of a recording medium to be fed to the secondary transfer nip include, but are not limited to use of a thickness detector to detect a thickness of a recording medium P in the paper feed unit 30 used in the image forming operation and use of recording medium information entered by users via an operation panel 403 (shown in FIG. 2) serving as an instruction receiver (e.g., a classification information receiver) of the image forming apparatus.

In an example of the use of recording medium information entered by users, control tables for patterns 1 through 6 as shown in FIGS. 12A through 12F are prepared, and the operation panel 403 shows multiple types of recording media A through C (in FIG. 13, listed as Paper A through Paper C), urging the user to select. As shown in FIG. 13, each of the types of recording media A through C is correlated with the control table before the recording medium P is free from the alignment control (Area A) and the control table after the recording medium P is free from the alignment control (Area B, trailing edge). With this configuration, when the user selects the type of recording medium among Paper A through Paper C shown on the operation panel 403, the controller 400 uses the corresponding control table and performs the transfer current control before and after the recording medium P is free from the alignment control.

Next, with reference to FIG. 14, a description is provided of results of effect verification tests performed by the present inventors.

FIG. 14 is a table showing the results of effect verification tests.

In FIG. 14, Embodiment 1 refers to an example in which the transfer current control was performed in the image forming apparatus of the illustrative embodiment using the control table shown in FIG. 10 before and after the recording medium was free from the alignment control. Embodiment 2 refers to an example in which the transfer current control was performed in the image forming apparatus of the illustrative embodiment using the control tables of FIGS. 11A and 11B before and after the recording medium P was free from the alignment control. Embodiment 3 refers to an example in which the transfer current control was performed in the image forming apparatus of the illustrative embodiment using the control tables of FIGS. 12A through 12F before and after the recording medium P was free from the alignment control. Embodiment 4 refers to the same example as Embodiment 1, except that the intermediate transfer belt 8 was an inelastic belt. In FIG. 14, Comparative Example refers to as example in which the transfer current control was performed using the control table shown in FIG. 8 before and after the recording medium P was free from the alignment control.

The types of recording medium used in the verification tests are as follows.

Thick Sheet A: Mondi Color Copy (registered trademark, basis weight=300 gsm);

Thick Sheet B: Munken Lynx (registered trademark, basis weight=400 gsm);

Thick Sheet C: Mango Star (registered trademark, basis weight=400 gsm);

Regular Sheet A: Type-600070W Regular Sheet A: POD Gloss Coat (registered trademark, basis weight 128 gsm)

With regards to the evaluation of the trailing-edge toner voids, when trailing-edge toner void was not confirmed at all, it was evaluated as "GOOD". When some toner voids were present in an area less than 6 mm from the trailing edge of the recording medium P, but no toner void was not present in an area 6 mm from the trailing edge or beyond, it was evaluated as "FAIR" (Because the margin at the trailing edge was 4 mm, the appearance of the toner voids was insignificant.) When toner voids were present in an area more than 6 mm from the trailing edge of the recording medium, it was evaluated as "POOR". With regards to the evaluation of image density, when the image density was in a permissible range, it was graded as "GOOD". When the image density was out of the permissible range, but degradation of the image density was not significant, it was graded as "FAIR". When degradation of the image density was significant, it was graded as "POOR".

As illustrated in FIG. 14, in the comparative example, the evaluation of the trailing-edge toner void was "POOR" with respect to Thick Sheet A, B, and C. By contrast, in Embodiments 1, 2, 3, and 4, the evaluation of the trailing-edge toner void was either "GOOD" or "FAIR".

Although the embodiment of the present disclosure has been described above, the present disclosure is not limited to the foregoing embodiments, but a variety of modifications can naturally be made within the scope of the present disclosure.

[Aspect A]

An image forming apparatus includes an image bearer such as the intermediate transfer belt 8 with a surface to move, a toner image forming device such as the process units 6Y, 6M, 6C, and 6K, and the optical writing unit 20 to form a toner image on the surface of the image bearer based on image information, a transfer device such as the secondary transfer device 200 to transfer the toner image from the image bearer onto a recording medium P in a transfer region with a transfer bias applied to the transfer region, a recording medium conveyor such as the upper entry guide 34A, the lower entry guide 34B, and the pair of registration rollers 33 to deliver the recording medium to the transfer region while controlling alignment of the recording medium that has entered the transfer region such that a trailing edge side of the recording medium relative to the transfer region is curved in alignment control, and a transfer bias controller such as the controller 400 to obtain a toner adhesion amount information on a post-alignment-control toner image that passes through the transfer region after the recording medium is free from the alignment control, and to reduce the transfer bias after the alignment control to a level less than a level of a transfer bias that is applied when the toner image having a same toner adhesion amount passes through the transfer region before the recording medium is free from the alignment control, in a case in which the toner adhesion amount per unit area is less than a predetermined amount.

It is recognized by the present inventors that when the recording medium conveyor releases the recording medium the trailing edge side of the recording medium springs up, hence generating an electrical discharge which then produces the trailing-edge toner void. This trailing-edge toner void appears more pronounced when the image area ratio of the toner image (i.e., a post-alignment-control toner image) that passes through the transfer region after the recording medium conveyor releases the recording medium is relatively low, such as when the toner adhesion amount per unit area is relatively small. In this case, it is difficult to prevent the trailing-edge toner void even when the configuration of the recording medium conveyor is optimized to transport reliably the recording medium P.

By contrast, in a case in which the post-alignment-control toner image has a high image area ratio, the trailing-edge toner void can be easily prevented by optimizing the configuration of the recording medium conveyor within a range in which the quality of conveyance of the recording medium is not degraded. However, if the transfer bias is reduced to prevent the trailing-edge toner void when the post-alignment control toner image passes through the transfer region, the amount of the transfer current that flows in the transfer region decreases with the reduced transfer bias. At this time, when the image area ratio of the toner image in the transfer region is relatively high, the degree by which the transfer rate decreases is significant relative to the reduction in the transfer current. As a result, the image density of the toner image decreases. By contrast, when the image area ratio of the toner image in the transfer region is relatively low, the degree by which the transfer rate decreases is small relative to the reduction in the transfer current. Therefore, a decrease in the image density of the toner image is insignificant.

In view of the above, according to the present illustrative embodiment, in a case in which the toner adhesion amount per unit area obtained from the toner adhesion amount information of the post-alignment-control toner image that passes through the transfer region after the recording medium is free from the regulation is less than a certain amount, the transfer bias less than the transfer bias when the toner image corresponding to the same toner adhesion amount information passes through the transfer region before the regulation of the recording medium is released. With this configuration, in a case in which the post-alignment-control toner image has a low image area ratio (i.e., when the toner adhesion amount per unit area is relatively low), the trailing-edge toner void, which is difficult to prevent by optimizing the configuration of the recording medium conveyor, can be prevented by reducing the transfer bias.

Furthermore, when the image area ratio of the post-alignment-control toner image is relatively low, as described above, a decrease in the image density of the toner image is insignificant even when the transfer bias is reduced. With this configuration, in a case in which the post-alignment-control toner image has a high image area ratio (i.e., when the toner adhesion amount per unit area is relatively high), although the image density decreases easily with a reduced transfer bias, the trailing-edge toner void can be prevented by optimizing the configuration of the recording medium or any other desired structure. Therefore, when the image area ratio of the post-alignment-control toner image portion is relatively high, the image density is prevented from decreasing by not reducing the transfer bias while preventing the trailing-edge toner void.

[Aspect B]

According to Aspect A, based on the image information, the transfer bias controller obtains information on a toner adhesion amount at each toner image portion corresponding to the image information in the moving direction of the surface of the image bearer. Subsequently, the transfer bias controller controls the transfer bias in the transfer current control such that the transfer current that flows when each toner image portion passes through the transfer region changes in accordance with the information on the toner adhesion amount of the toner image portion.

With this configuration, a proper amount of transfer current is supplied in accordance with the image area ratio of the toner image that passes through the transfer region, hence preventing improper transfer such as inadequate transfer and overcharged transfer caused by the difference in the image area ratio.

[Aspect C]

According to Aspect B, the image forming apparatus further includes a storage device such as the ROM 400*b* to store correlation information between the toner adhesion amount information and the transfer bias. The correlation information includes first correlation information used in the transfer current control before the recording medium is free from the alignment control and second correlation information used in the transfer current control after the recording medium is free from the alignment control. The transfer bias controller determines the transfer bias before the recording medium is free from the alignment control based on the first correlation information, and determines the transfer bias after the recording medium is free from the alignment control based on the second correlation information.

This configuration allows the transfer bias controller to control the transfer bias with ease.

[Aspect D]

According to Aspect C, the image forming apparatus further includes a classification information retriever such as the thickness detector and the operation panel 403 to obtain classification information on the recording medium delivered by the recording medium conveyor. The storage device stores, with respect to at least one of the first correlation information and the second correlation information, multiple correlation information for each classification information on the recording medium. In a case in which the transfer bias controller adjusts the transfer current using at least one of the first correlation information and the second correlation information, the transfer current controller uses one of the first correlation information and the second correlation information corresponding to the classification information obtained by the classification information retriever.

The transfer bias or the transfer current that causes the trailing-edge toner void and degradation of image density reproducibility depends on a type (e.g., material, a thicknesses, and so forth) of a recording medium. For this reason, if the same transfer current control is performed regardless of the type of the recording medium, the trailing-edge toner void and the degradation of image density reproducibility may occur. According to the present illustrative embodiment, the transfer current control is performed using the correlation information associated with the type of the recording medium. With this configuration, the trailing-edge toner void and the degradation of image density reproducibility are prevented with respect to various types of recording media.

[Aspect E]

According to Aspect D, the classification information includes information to distinguish at least one of a thickness and a material. With this configuration, the trailing-edge toner void and image density reproducibility are prevented properly in accordance with the type of the recording medium.

[Aspect F]

According to Aspect D or Aspect E, the classification information retrieving device includes an operation receiver such as an operation panel or the like that receives instructions from users who specify the classification of the recording medium. With this configuration, the classification information of the recording medium can be retrieved with ease.

[Aspect D]

According to any one of Aspects A through F, the image bearer is constituted of an elastic belt including an elastic layer. The present inventors have recognized that, in general, the trailing-edge toner void is easily generated when the image bearer is an elastic belt. With the combination of the elastic belt and the present disclosure, the trailing-edge toner void and image density reproducibility are prevented effectively in accordance with the type of the recording medium.

According to an aspect of this disclosure, the present disclosure is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer with a surface to move;

a toner image forming device to form a toner image on the surface of the image bearer based on image information;

a transfer device to transfer the toner image from the image bearer onto a recording medium in a transfer region with a transfer bias applied to the transfer region;

a recording medium conveyor to deliver the recording medium to the transfer region while controlling alignment of the recording medium that has entered the transfer region such that a trailing edge side of the recording medium relative to the transfer region is curved in alignment control;

a transfer bias controller to obtain information on a toner adhesion amount of a post-alignment-control toner image that passes through the transfer region after the recording medium is free from the alignment control, and to reduce the transfer bias, after the alignment control is released, to a level less than a level of the transfer bias that is applied when the toner image having a same toner adhesion amount passes through the transfer region before the recording medium is free from the alignment control, in a case in which a toner adhesion amount per unit area obtained from the information on the toner adhesion amount of the post-alignment-control toner image is less than a predetermined amount, the transfer bias controller further being configured to obtain, in a transfer current control toner adhesion amount, information on each of toner image segments corresponding to the image information in a surface moving direction of the image bearer, and to adjust the transfer bias such that a transfer current that flows when each of the toner image segments passes, through the transfer region, changes in accordance with the toner adhesion amount information on each of the toner image segments; and a storage device to store correlation information between the toner adhesion amount information and the transfer bias, the correlation information including first correlation information used in the transfer current control before the recording medium is free from the alignment control and second correlation information used in the transfer current control after the recording medium is free from the alignment control;

wherein the transfer bias controller is further configured to determine the transfer bias before the recording medium is free from the alignment control based on the first correlation information, and is further configured to determine the transfer bias after the recording medium is free from the alignment control based on the second correlation information.

2. The image forming apparatus according to claim 1, further comprising a classification information retriever to obtain classification information on the recording medium delivered by the recording medium conveyor, wherein the storage device is further configured to store, with respect to at least one of the first correlation information and the second correlation information, multiple correlation information for each classification information on the recording medium, and wherein in a case in which the transfer bias controller adjusts the transfer current using the at least one of the first correlation information and the second correlation information, the transfer current controller is further configured to use one of the multiple correlation information corresponding to the classification information obtained by the classification information retriever.

3. The image forming apparatus according to claim 2, wherein the classification information includes information that distinguishes at least one of thickness and material of the recording medium.

4. The image forming apparatus according to claim 3, wherein the image bearer includes an elastic belt with an elastic layer.

5. The image forming apparatus according to claim 2, wherein the classification information retriever includes an operation receiver to receive an instruction of users specifying classification of the recording medium.

6. The image forming apparatus according to claim 5, wherein the image bearer includes an elastic belt with an elastic layer.

7. The image forming apparatus according to claim 2, wherein the image bearer includes an elastic belt with an elastic layer.

8. The image forming apparatus according to claim 1, wherein the image bearer includes an elastic belt with an elastic layer.

* * * * *